United States Patent [19]

Van Natta

[11] Patent Number: 4,521,962

[45] Date of Patent: Jun. 11, 1985

[54] GROOMING DEVICE

[76] Inventor: Harold Van Natta, 339 Canna Dr., Valdosta, Ga. 31601

[21] Appl. No.: 584,004

[22] Filed: Feb. 27, 1984

[51] Int. Cl.[3] ..... B26B 19/20; B26B 19/26

[52] U.S. Cl. ..... 30/34.1; 30/29.5

[58] Field of Search ..... 30/29.5, 34.1, 34 R

[56] References Cited

U.S. PATENT DOCUMENTS

| | | | |
|---|---|---|---|
| 2,336,160 | 12/1943 | Boyd | 30/29.5 |
| 2,783,533 | 3/1957 | Wilson | 30/29.5 |
| 2,987,818 | 6/1961 | Rosenstein | 30/29.5 |
| 3,101,535 | 8/1963 | Andis | 30/29.5 |
| 3,381,373 | 5/1968 | Brown | 30/29.5 |
| 3,524,253 | 8/1970 | Hoke | 30/29.5 |
| 3,731,379 | 5/1973 | Williams | 30/29.5 |
| 3,829,966 | 8/1974 | Owens | 30/29.5 |
| 3,925,888 | 12/1975 | Bozsanyi | 30/29.5 |
| 4,085,503 | 4/1978 | Beck | 30/34.1 |

FOREIGN PATENT DOCUMENTS

| | | | |
|---|---|---|---|
| 37156 | 3/1977 | Japan | 30/29.5 |

*Primary Examiner*—Jimmy C. Peters

*Attorney, Agent, or Firm*—Kirschstein, Kirschstein, Ottinger & Israel

[57] ABSTRACT

A grooming device includes a cutting arrangement for cutting hair that grows in or at the nostrils and/or the ear channels of the head of a human being. This cutting arrangement includes a shielding element and a cutting element including a driving member supported in the shielding element only for rotation about an axis relative to the shielding element. The cutting arrangement is mounted on a housing of the device for movement in unison into and out of the housing between an extended and a retracted position and back. In the extended position, a lug received, after turning of the shielding element about the axis, in a confining recess of the housing, arrests the cutting arrangement in its extended position. Alternatively, a pin passing through a C-shaped through recess in the housing to the exterior of the latter serves the same purpose. A distancing comb is received in a recess of a trimming arrangement arranged on the housing spacedly from the cutting arrangement, when the comb is in its retracted position. In its extended position, the comb is situated a predetermined distance away from the trimming arrangement, thus preventing cutting of hair too close to skin. A pushbutton operated actuating arrangement keeps the distancing comb in its extended and in its retracted position.

19 Claims, 12 Drawing Figures

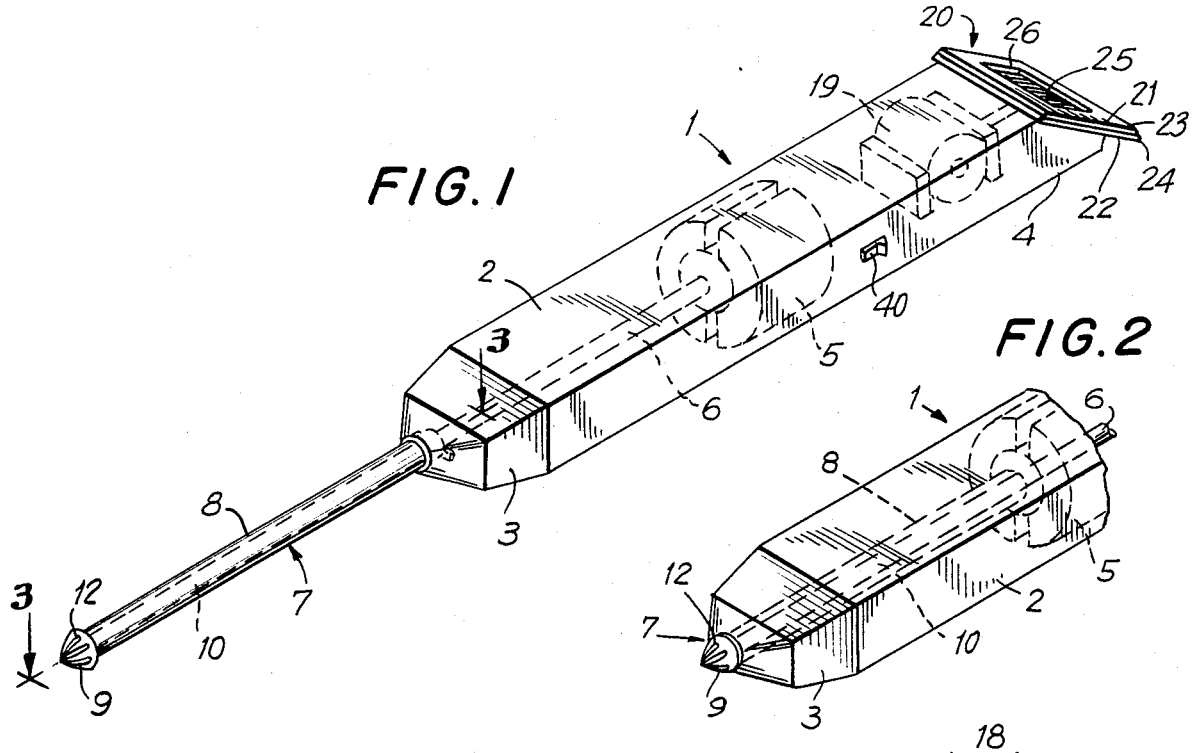
FIG. 1
FIG. 2
1
2
3
4
5
6
7
8
9
10
12
19
20
21
22
23
24
25
26
40
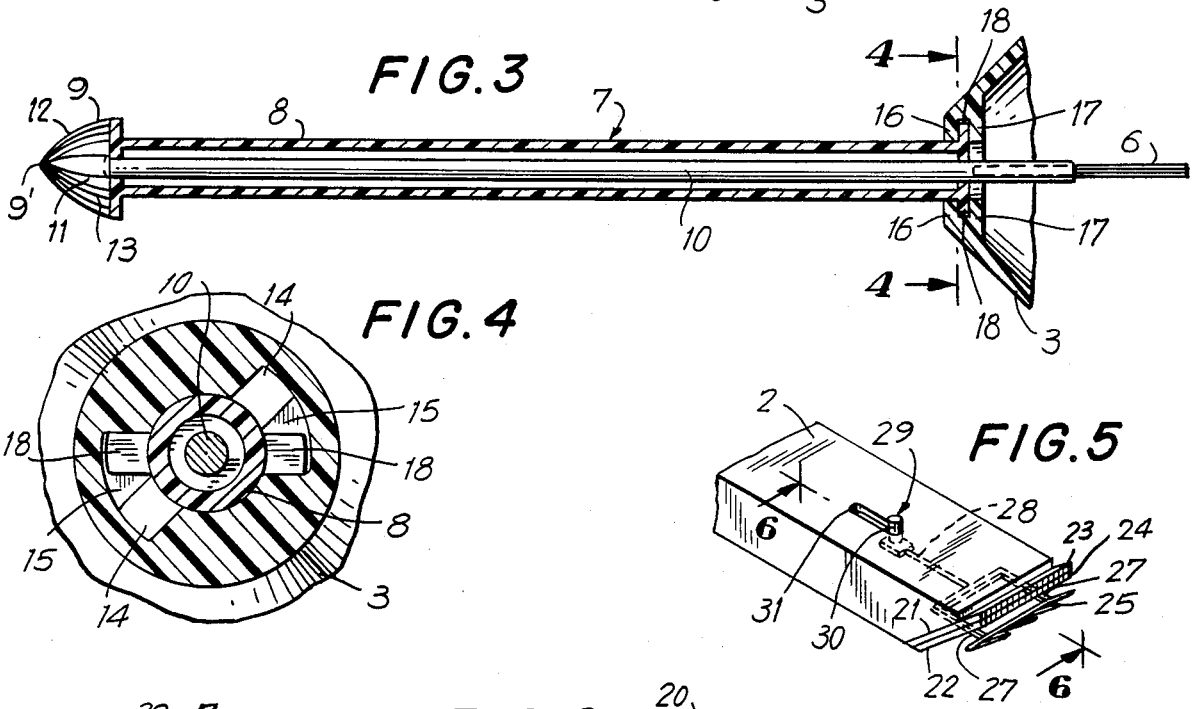
FIG. 3
FIG. 4
FIG. 5
FIG. 6
FIG. 7
3
4
6
7
8
9
9'
10
11
12
13
14
15
16
17
18
2
21
22
23
24
25
27
28
29
30
31
32
33
34
35
36
39
39'
41
19
20
26

GROOMING DEVICE

BACKGROUND OF THE INVENTION

The present invention relates to cutting or grooming devices in general and, more particularly, to such grooming devices which are intended for cutting human hair that grows at regions of the head outside the scalp, especially the hair growing in the nostrils, the ears, and at the eyebrows, mustache and sideburns.

Experience has shown that, in addition to the hair growing at the scalp area of the human head, and the facial hair growth especially for adult males, additional hair may also grow in the nostrils, and/or in the ears and, obviously, at the area of the eyebrows, mustache and sideburns as well. Now, while a wide variety of electric shaving devices has been developed to deal with the problem of daily removal of the facial hair for those males who wish to have the clean-shaven look, no grooming device is currently available which would give satisfactory performance in the area of cutting hair growing from nostrils, ear channels, and adjacent areas. Also, there is not available on the market any grooming device of the above type which would also be able to trim the eyebrows, mustache and sideburns at a predetermined distance away from the head, to give the user a well-groomed look.

This, however, does not mean that no attempts have been previously made to come up with grooming devices of this or similar sort. So, for instance, U.S. Pat. Nos. 2,987,818; 3,381,373; 3,524,253; 3,731,379; 3,829,966; and 3,925,888 disclose various constructions of cutting devices intended for use in the removal of hair from the nasal passages or ear channels. However, these devices have not been very successful in the marketplace, especially since they are one-purpose devices and can be easily damaged because of their rather fragile small-sized construction and lack of adequate protection for the most vulnerable parts thereof. On the other hand, the U.S. Pat. Nos. 2,336,160; 2,783,533; and 3,101,535 disclose trimming devices or attachments of various sorts, which can be used for trimming hair of a mustache or that of an eyebrow. However, a pronounced disadvantage of these arrangements is that the user has to estimate the distance at which this arrangement cuts the hair away from the skin, which may lead to misjudgement and thus to removal of too much of the hair.

SUMMARY OF THE INVENTION

Accordingly, it is an object of the present invention to avoid the disadvantages of the prior art.

More particularly, it is an object of the present invention to provide a grooming device for use by and on humans, which does not possess the disadvantages of the conventional devices of this type.

Still another object of the present invention is so to construct the grooming device of the type here under consideration as to be especially suited for removal of hair from nostrils or ear channels and their vicinity, and yet not to be so vulnerable to damage as the conventional grooming devices of this kind.

It is yet another object of the present invention so to design the grooming arrangement of the above type as to be also capable of removing hair of, for instance, eyebrows, mustache and sideburns, at a predetermined distance from the skin of the user.

A concomitant object of the present invention is to develop a grooming device of the above type which is simple in construction, easy and inexpensive to manufacture, easy to use, and reliable in operation nevertheless.

In pursuance of the above objects and others which will become apparent hereafter, one feature of the present invention resides in a grooming device for use in cutting hair growing at diverse locations of the human head outside the scalp area, this device comprising a housing; means for cutting hair located in and adjacent various channels of the human head including a protective element and a cutting element mounted in the protective element for rotation about an axis; means for mounting the cutting means in the housing for movement in unison between a retracted position in which the cutting means is at least predominantly situated within the outline of the housing, and an extended position in which the cutting means extends to a considerable extent beyond the outline of the housing; and means for driving the cutting element in rotation relative to the protective element about the aforementioned axis at least in the extended position of the cutting means.

A particular advantage of the grooming device as described so far is that, since most of the damage in the conventional arrangements usually occurs during the period of non-use or storage, when the exposed position of the cutting arrangement or means makes the latter especially vulnerable, the mounting of the cutting means on the housing for the aforementioned movement between its extended and retracted positions renders it possible to make full and advantageous use of the cutting arrangement in its extended position, and yet to move the cutting arrangement into a rather sheltered retracted position for the periods of non-use.

A particularly simple and especially advantageous construction of the cutting means is obtained when the protective element includes an elongated tubular shielding portion having two longitudinally spaced end portions one of which is closer to the housing at least in the extended position, and a head portion mounted on the other of the end portions of the shielding portion and bounding a cutting head compartment, and when the cutting element includes an elongated cutting member rotatably supported in the shielding portion and a cutting head substantially conformingly received in the cutting head compartment of the head portion. Then, it is particularly advantageous when the head portion of the protective element has a substantially dome-shaped configuration of a base diameter exceeding that of the shielding portion.

It is particularly advantageous when the mounting means mounts the cutting means on the housing for telescoping movement into and out of the housing. This construction is particularly simple and reliable.

Advantageously, there is further provided means for arresting the cutting means at least in the extended position thereof relative to the housing. Such arresting means may include, for instance, at least one substantially axially extending opening in the housing, and at least one confining channel extending circumferentially from the opening in the housing, as well as at least one substantially radial projection extending outwardly from the shielding portion within the housing and so disposed and dimensioned as to pass through the opening when aligned therewith as the cutting means approaches the extended position thereof, and to be confiningly received in the confining channel in the extended position of the cutting means upon turning of the shielding portion in one direction about the aforementioned axis. In the alternative, the arresting means may include at least one substantially axially extending through slot in the housing, the slot including at least one en portion that extends circumferentially and slightly in the opposite axial direction from the main course of the slot, and at least one substantially radially extending pin-shaped projection extending outwardly from the shielding portion within the housing and through the slot to the exterior of the housing to be engaged and manipulated into the one end portion as the cutting means is displaced toward and into the extended position thereof.

According to a currently preferred aspect of the present invention, the driving means includes an externally splined output shaft, and the driving member is hollow and internally splined to at least partially receive the output shaft and to be driven in rotation thereby. The driving means advantageously further includes an electric motor. In this case, the output shaft can be directly constituted by the output shaft of the electric motor. However, it is also possible and advantageous to provide the electric motor with its own, additional, output shaft, and to interpose either a train of spur gears, or at least two meshing bevel gears, between this additional output shaft and the splined output shaft referred to before.

According to a further advantageous concept of the present invention, the grooming device further comprises means for trimming hair, such trimming means being mounted at a location of the housing that is remote from the location of the cutting means. Such trimming means advantageously includes two trimming blades mounted on the aforementioned location for movement relative to one another, at least that of the trimming blade that is more remote from the housing having a recess therein; and when there is further provided means for driving the trimming means, such driving means including a vibrating magnetic clipper or an electric motor. Then there is advantageously further provided at least one distancing element mounted on the housing for movement between a retracted position in which it is accommodated in the recess of the remote cutting blade, and a pair of extended positions in which it is spaced at either one of two predetermined distances from the remote trimming blade.

The grooming device advantageously further includes means for keeping the distancing element in each of the extended and retracted positions, including means for bounding two axially extending aligned channels in the housing; partitioning wall means extending between the channels; means for defining a through slot in the housing penetrating to the partitioning wall means and having a width smaller than that of the channels; an actuating button arrangement including an actuating button that includes an actuating portion extending through the slot to the exterior of the housing, an enlarged portion received in one of the channels and dimensioned larger than the slot to be able to bypass the partitioning wall means only when displaced out of the channels into the interior of the housing, and means for urging the enlarged portion of the actuating button into the respective channel; and means for connecting the actuating button arrangement to the distancing element. The distancing element advantageously has a substantially comb-shaped configuration.

The novel features which are considered as characteristic of the invention are set forth in particular in the appended claims. The improved grooming device itself, however, both as to its construction and its mode of operation, together with additional features and advantages thereof, will be best understood upon perusal of the following.detailed description of certain specific embodiments with reference to the accompanying drawing.

BRIEF DESCRIPTION OF THE DRAWING

FIG. 1 is a perspective view of a grooming device according to the present invention;

FIG. 2 is a view similar to that of FIG. 1 but only of a fraction of the device with a retracted cutting arrangement;

FIG. 3 is an enlarged sectional view taken on line 3—3 of FIG. 1;

FIG. 4 is a partly cross-sectional view taken on line 4—4 of FIG. 3;

FIG. 5 is a perspective view of a part of the device of FIG. 1 substantially complementary to that of FIG. 2;

FIG. 6 is a sectional view taken on line 6—6 of FIG. 5;

FIG. 7 is a sectional view taken on line 7—7 of FIG. 6;

DETAILED DESCRIPTION OF THE PREFERRED EMBODIMENTS

Figure 8:
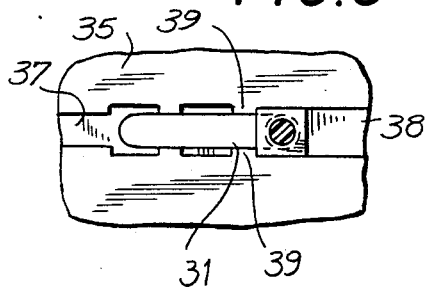
FIG. 8 is a sectional view taken on line 8—8 of FIG. 6.

Referring now to the drawing in detail, and first to FIG. 1 thereof, it may be seen that the reference numeral 1 has been used to identify a grooming device constructed according to the present invention, in its entirety. The grooming device 1 includes a housing 2 which is elongated and includes longitudinally spaced end portions 3 and 4. The housing 2 is shown to be rectangular in cross section, but it will be appreciated that it can have any other cross-sectional shape as desired. The end portion 3 is shown in FIG. 2 to taper or converge in the direction away from the remainder of the housing 2. An electric motor 5 having an output shaft 6 is accommodated in the interior of the housing 2 at a predetermined distance from the end portion 3 in such a manner that the output shaft 6 extends toward the end portion 3.

As a comparison of FIGS. 1 and 2 will reveal, a protective elongated shielding element 7 is mounted on the end portion 3 of the housing 2 for telescoping movement into and out of the interior of the housing 2. The shielding element 7 includes a tubular sleeve portion 8 and a cutting head portion 9 mounted at the free end of the sleeve portion 8. The length of the sleeve portion 8 is substantially equal to, or somewhat less than, the distance of the electric motor 5 from the end portion 3, so that the shielding element 7 can enter the housing 2 at least to the extent shown in FIG. 2 without abutting the electric motor 5.

As indicated in FIG. 3, the output shaft 6 of the electric motor 5 is externally splined at least at the region of its free end portion. The output shaft 6 extends into the interior of an elongated substantially rod-shaped driving member 10 which is accommodated in the interior of the shielding element 7 and especially the tubular sleeve portion 8 of the latter and is shown to extend to a predetermined extent into the interior of the housing 2. The driving member 10 is hollow and internally splined at least over a predominant part of its length amounting to the aforementioned distance and the aforementioned extent, or at least slightly more. The driving member 10 is supported in the interior of the shielding element 7 for rotation about its axis relative to the shielding element 7, but is held in position relative to the shielding element 7 as considered in the axial direction. This holding action may be effectuated, for instance, by a cutting head 11 which is secured to the driving member 10 and is received and confined in the interior of the cutting head portion 9 of the shielding element 7. The cutting head portion 9 has a bearing 9' at its apex and may receive the cutting head 11 with a small amount of axial leeway, so that the driving member 10 will be able to conduct a correspondingly small axial movement relative to the shielding element 7. However, this leeway is so small as to be negligible and is provided only in order to prevent seizing of the cutting head 11 in the cutting head portion 9, due to manufacturing inaccuracies or the like. It will be appreciated that, as the shielding element 7 is axially displaced into or out of the housing 2, the bearing 9' will engage the cutting head 11, and the driving member 10 will be entrained for movement therewith in the axial direction of the output shaft 6, so that the latter will penetrate more and more into the hollow driving member 10 in the first instance, and gradually emerge from the driving member 10 in the second instance, while the external and internal splines of the output shaft 6 and of the driving member 10 remain in engagement with one another. While it is possible to provide the splines only on the free end portion of the output shaft 6 to the extent that it penetrates into the hollow driving member 10 in the extended position of the shielding element 7, and in the driving member 10 to the corresponding extent at the end portion of the latter that extends into the interior of the housing 2, it is currently preferred, for manufacturing reasons and in order not to have to provide for alignment of the external and internal splines each time the shielding element 7 approaches its extended position, to provide the splines over the entire length of the output shaft 6, or the entire length of the internal passage of the driving member 10, or both. The electric motor 5 may be so constructed as to permit the penetration of that portion of the driving member 10 which extends into the interior of the housing 2 in the extended position of the shielding element 7 into its interior without interfering with the movement of the driving member 10 into the retracted position of the latter that corresponds to the retracted position of the shielding element 7, or it may be positioned correspondingly farther away from the end portion 3 of the housing 2, in which case the shielding element 7 will be correspondingly spaced from the electric motor 5 in its retracted position.

FIG. 3 also shows that the cutting head portion 9 of the shielding element 7 has a basically dome-shaped configuration and is suitably perforated, such as being provided with slots 12 extending generally in the axial direction. The cutting head 11 has a substantially conforming outline and includes a plurality of cutting blades or portions 13 that move past the slots 12 during the rotation of the cutting head 11 with the driving member 10 and the output shaft 6 of the electric motor 5 when the latter is energized. The cutting head 11 is intended for cutting hair growing in nostrils and ears, so that it, as well as the cutting head portion 9 of the shielding element 7 are so dimensioned and configurated as to easily enter these body cavities or channels and be capable of being maneuvered therein. The aforementioned dome-shaped configuration is especially suited for these purposes.

During the use of the grooming device 1 for this purpose with the shielding element 7 in its extended position, it is necessary or at least advantageous to assure that the shielding element 7 is not inadvertently, gradually or suddenly, displaced toward its retracted position by axial pressure applied against it during such use, or by gravitational forces or the like. For this reason, the end portion 3 is provided, as indicated in FIG. 4, with a plurality of openings 14 (two such openings 14, arranged diametrically opposite one another, being shown) which are adjoined in the same circumferential direction, which preferably coincides with the direction of rotation of the output shaft 6 of the electric motor 5, by respective sector-shaped recesses 15 that are bounded by wall portions 16 and 17 of the end portion 3 of the housing 2, as shown in FIG. 3. Then, the protective sleeve 8 has substantially radially extending tabs 18 having configurations conforming to the openings 14 and the recesses 15 as considered in a plane normal to the axis of the sleeve portion 8 and perpendicularly thereto, respectively, there being the same number and distribution of the tabs 18 as those of the openings 14 and recesses 15. This, of course, means that, as the shielding element 7 approaches its extended position, it can be manipulated by turning the same until the tabs 18 are aligned with the openings 14, if such manipulation is necessary, whereupon the displacement of the shielding element 7 toward its extended position can be continued with the tabs 18 passing through the respective openings 14 until they abut the wall portion 16, which is followed by turning of the shielding element 7 in the appropriate direction, so that the tabs 18 enter the recesses 15 and prevent displacement of the shielding element 7 in any axial direction, due to their confinement between the wall portions 16 and 17. When, as mentioned above, the appropriate direction coincides with the direction of rotation of the output shaft 6 and thus of the driving member 10 during the use of the grooming device 1 for cutting hair in nostrils or ears, there is obtained the advantage that friction between the driving member 10 and the shielding element will keep the tabs 18 in the recesses 15, rather than tending to displace the tabs into alignment with the openings 14, which could occur if the recesses 15 were located at the opposite circumferential sides of the openings 14.

As further shown in FIG. 1, the grooming device 1 is provided, at its other axial end 4, with a vibrating magnetic clipper 19 which, like the motor 5, is of a conventional construction and, hence, need not be shown in any greater detail. The clipper 19, which is also an electrically energized motor, is employed to reciprocally drive a trimming arrangement 20 that includes two trimming blades 21 and 22 which conduct relative movement with respect to one another along a common plane to which the trimming blades 21 and 22 are parallel, during the operation of the clipper 19. The type of the clipper 19, and the transmission between the same and one or both of the trimming blades 21 and 22, as well as the configurations of the latter, are so well known as not to require any explanation here. Suffice it to say that the cutting or trimming blades 21 and 22 have respective cutting edge regions 23 and 24 which are so configurated as to sever any hair that reaches these regions 23 and 24 while the clipper 19 is in operation. So, for instance, the regions 23 and 24 may have recesses bounded by cutting portions which move respectively transversely of the associated recesses during the operation of the motor 19, so that any hair entering the recesses while aligned will be cut as the associated cutting portions move across the respective recesses.

The trimming arrangement 20 is constructed, according to the present invention, in such a manner as to cut hair, such as that of eyebrows, mustache and sideburns, each at a predetermined distance from the body of the user of the grooming device 1. To this end, there is provided a distancing element 25 which is shown to be configurated as a miniature comb. When the comb, shown by dashed lines in FIG. 6, is accommodated in a depression or cutout 26 of the trimming blade 22, the pair of trimming blades may be used to trim one's sideburns. However, as shown in FIG. 5, the distancing element or comb 25, shown by solid lines in FIG. 6, can be displaced into a first extended mustache-trimming position in which it is spaced a first desired distance from the trimming blade 22. Alternately, the comb 25, shown by dot-dashed lines in FIG. 6, can be displaced into a second extended eyebrow-trimming position in which it is spaced a shorter second desired distance from the trimming blade 22. The first and second distances are about $\frac{1}{4}''$ and $\frac{1}{8}''$, respectively, away from the trimming blade 22. The comb 25 is mounted on two laterally spaced mounting rods 27 that are commonly connected, by means of a connecting rod 28, to an actuating button arrangement 29 including an actuating button 30 that extends through a longitudinally extending slot 31 to the exterior of the housing 2. Details of the actuating button arrangement 30 can be ascertained from FIG. 6. As shown there, the connecting rod 28 is connected to, as by being embedded in, a cup-shaped component 32 of the actuating button arrangement 29. The component 32 bounds an internal compartment 33 that accommodates a helical compression spring 34 and is dimensioned to partially accommodate the button 30 at least when the latter is depressed. The helical compression spring 34 presses the actuating button 30 in the direction indicated by a bold-line arrow in FIG. 6 against a wall portion 35 of the housing 2. The button 30 has an enlarged portion 36 which contacts the wall portion 35 at opposite sides of the slot 31, as may best be seen in FIG. 7. As a comparison of FIGS. 5, 6 and 7 will reveal, the wall portion 35 of the housing 2 is provided with two longitudinally extending aligned channels 37 and 38 which are separated from one another by partitioning wall zones 39, 39' that, in turn, are penetrated by the slot 31. The channels 37 and 38 are somewhat wider than the slot 31, being dimensioned to receive the enlarged portion 36 of the button 30, while the partitioning wall zones 39, 39' are dimensioned commensurately with the slot 31 and, hence, leave a somewhat lesser clearance therebetween than necessary to permit the enlarged portion 36 to pass through such clearance from the channel 37 into the channel 38, or vice versa. Consequently, the cup-shaped element 32, and with it the connecting rod 28, the mounting rods 27, and the comb 25 mounted on the latter, cannot be displaced or inadvertently move from its position shown in solid lines in FIG. 6 into that indicated in dashed or dot-dashed lines, or vice versa, unless the button 30 is depressed to the extent needed for the enlarged portion 36 to fully enter the interior 33 of the cup-shaped element 32 and thus to clear the partitioning wall zones 39 or 39' and permit the movement of the enlarged portion 36 of the button 30 past the partitioning wall zones 39 or 39' from the channel 37 into the channel 38, or from the channel 38 into the channel 37.

The action of the actuating button arrangement in cooperation with the channels 37 and 38 and the partitioning wall zones 39, 39' of the wall portion 35 of the housing 2 renders it possible to arrest the distancing element 25 either in its retracted position of FIG. 1, or in either of its extended positions of, for instance, FIG. 6. The clipper 19 that drives the trimming arrangement 20 is put into or out of operation by means of an electrical switch 40 (see FIG. 1) which may be constructed as a three-position switch that shuts off both electric devices 5 and 19 in one of its positions, especially the middle one, and energizes only one of the devices 5 and 19 in the other two positions thereof; obviously, a different one of the devices 5 and 19 in each of the other two positions. Alternately, two separate switches, one for the clipper 19, and one for the motor 5, could be employed. Yet, the operation of the clipper 19 is independent of the position of the comb or distancing element 25, so that the trimming arrangement can be used with the distancing element and the associated parts 27 to 36 either in the mustache-trimming extended position, or the eyebrow-trimming extended position, or the sideburn-trimming retracted position. This, of course, means that the recess 26 will have to be dimensioned large enough to accommodate the distancing element 25 even during the operation of the trimming arrangement 20, and slots 41 in the trimming blade 21, through which the mounting portions 27 pass, will also have to be so designed as far as their arrangement and dimensions are concerned as to let the mounting portions 27 pass therethrough without mutual interference, whether the distancing element 25 assumes its retracted or either of its extended positions. It will be appreciated that, when the distancing element 25 is in its retracted position, it will permit the user to use the trimming arrangement 20 to cut the hair as close to the skin as desired. On the otherhand, when the distancing element 25 is in either of its extended positions, it will not permit the user of the trimming arrangement 20 of the grooming device 1 to get any closer to the skin than the distance permitted by the spacing of the distancing element 25 from the trimming blade 22. This means that the user can use the trimming arrangement 20 for trimming any unruly hair of, for instance, eyebrows or, if so desired, of sideburns, mustache, or the like, without having to worry about cutting hair that is desired to be kept.

While the enlarged portion 36 is shown in FIG. 8 to have a rectangular or square outline, it may also have any other desired shape, for instance, circularly cylindrical, so long as it is assured that it will not pass through the clearance between the partitioning wall zones 39, 39'.

Figure 9:
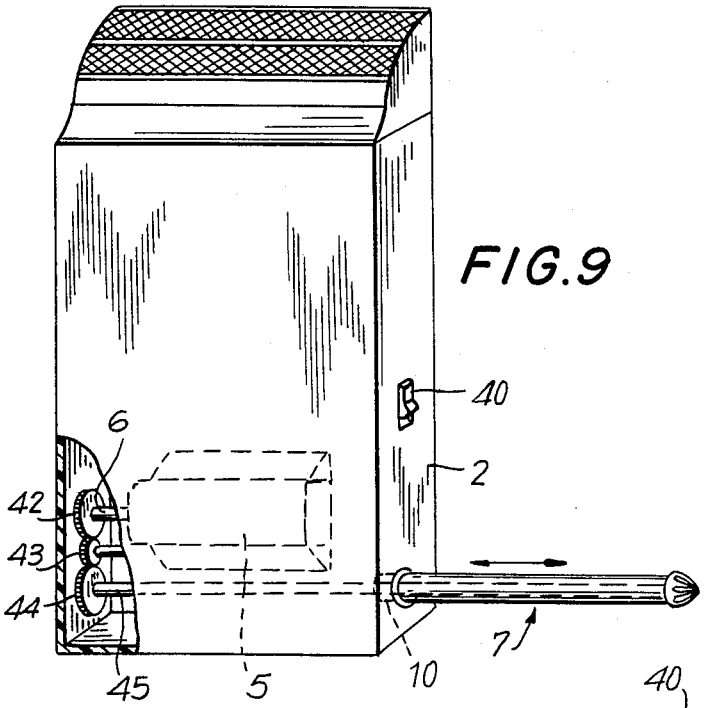
FIG. 9 is a view similar to that of FIG. 1 but showing a modified construction of the device.

In FIG. 9, there is illustrated incorporation of an arrangement akin to that disclosed in detail in connection with FIGS. 1 to 4 of the drawing, in a standard electric shaver of the Remington type. In this instance, the electric motor 5 drives, via its output shaft 6, a train of spur gears 42, 43 and 44, the last one of which rotates a splined shaft 45. Then, the driving member 10 is driven in rotation by the shaft 45 in the same manner as discussed before, and the shielding element 7 performs the same telescopically mounting and protecting function as discussed above.

Figure 10:
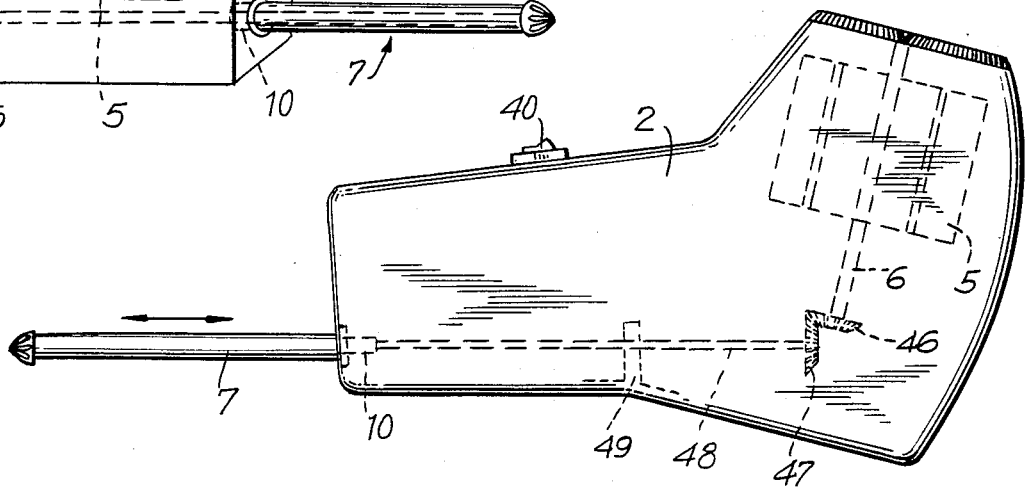
FIG. 10 is a view similar to that of FIG. 9 but depicting a different modified construction of the device.

FIG. 10 shows the incorporation of the same concept in a Norelco-type electric shaver. In this instance, the electric motor 5 which, incidentally, is the same motor as used for driving the rotating shaving heads, has a bevel gear 46 mounted on its output shaft 6. The bevel gear 26 meshes with a bevel gear 47 that is mounted for joint rotation on a splined shaft 48. The splined shaft 48 is rotatably mounted in at least one bearing 49 provided in the interior of the housing 2. Here again, the driving member 10 surrounds and engages a portion of the splined shaft 48 to derive its rotation from the latter. Once more, the shielding element 7 and the driving member 10 are telescopically extendable out of the housing 2 and retractable into the housing 2, in the manner described initially.

Figure 11:
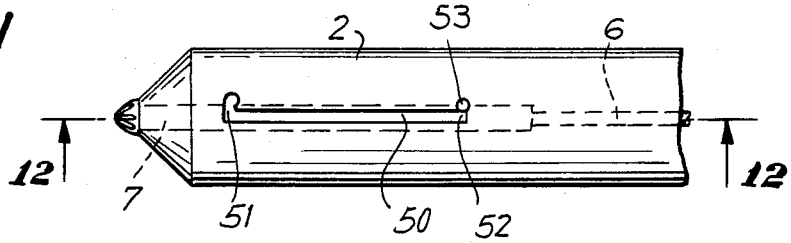
FIG. 11 is a view similar to FIG. 2 but showing a modification.
Figure 12:
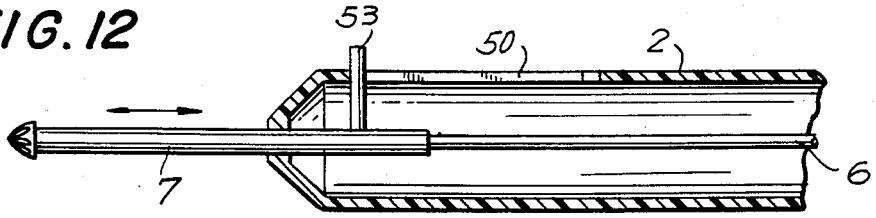
FIG. 12 is an axial sectional view taken on line 12—12 of FIG. 11.

FIGS. 11 and 12 depict an alternative construction of the shielding element 7 and of the housing 2, which permit arresting of the shielding element 7 (and thus of the driving member 10 and the cutting head 11 mounted on the latter) in either the extended or in the retracted position of the same. In this instance, the housing 2 is provided with a generally C-shaped slot having two end portions 51 and 52 that are slightly inclined opposite to the course of the slot 50 as they proceed circumferentially away from such course. A pin-shaped handle 53 is mounted on the shielding element 7 and extends substantially radially outwardly from the latter in the interior of the housing 2 and through and outwardly beyond the slot 50. The handle 53 can be used for displacing the shielding element 7 between its extended and retracted positions, but it has to be manipulated first, to get it out of the respective end portion 51 or 52 into the main course of the slot 50. Such manipulation requires a deliberate effort on the part of the user of the grooming device 1, and does not occur inadvertently, especially when the end portions 51 and 52 extend in the direction of rotation of the ouptut shaft 6 from the main course of the slot 50. This means that the shielding element 7 and the components 10 and 11 mounted in the latter merely for rotation relative thereto, are safely retained in their extended or retracted positions.

It will be understood that each of the elements described above, or two or more together, may also find a useful application in other types of arrangements differing from the type described above.

While the invention has been illustrated and described as embodied in a grooming device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. A grooming device for use in cutting hair growing at diverse locations of the human head outside the scalp area, comprising:

a housing;

means for cutting hair located in and adjacent various channels of the human head, including a protective element and a cutting element mounted in said protective element for rotation about an axis;

means for mounting said cutting means on said housing for movement in unison between a retracted position in which said cutting means is at least predominantly situated within the outline of said housing, and an extended position in which said cutting means extends to a considerable extent beyond the outline of said housing;

means for driving said cutting element in rotation relative to said protective element about said axis at least in said extended position of said cutting means;

means for trimming hair, mounted at a location of said housing that is remote from the location of said cutting means, said trimming means including two trimming blades mounted on said location for movement relative to one another, at least that of said trimming blades that is more remote from said housing having a recess therein;

means for driving said trimming means, including an electric clipper; and at least one distancing element mounted on said housing for movement between a retracted position in which it is accommodated in said recess of said remote cutting blade, and at least one extended position in which it is spaced a predetermined distance from said remote trimming blade.

2. The grooming device as defined in claim 1, wherein said protective element includes an elongated tubular shielding portion having two longitudinally spaced end portions one of which is closer to said housing at least in said extended position, and a head portion mounted on the other of said end portions of said shielding portion and bounding a cutting head compartment; and wherein said cutting element includes an elongated driving member rotatably supported in said shielding portion and a cutting head substantially conformingly received in said cutting head compartment of said head portion.

3. The grooming device as defined in claim 2, wherein said head portion has a substantially dome-shaped configuration of a base diameter exceeding that of said shielding portion.

4. The grooming device as defined in claim 2, wherein said mounting means mounts said cutting means on said housing for telescoping movement into and out of the latter.

5. The grooming device as defined in claim 4, and further comprising means for arresting said cutting means at least in said extended position thereof relative to said housing.

6. The grooming device as defined in claim 1, and further comprising means for keeping said distancing element in each of said extended and retracted positions, including means for bounding two axially extending aligned channels in said housing; partitioning wall means extending between said channels; means for defining a through slot in said housing penetrating through said partitioning wall means and having a width smaller than that of said channels; an actuating button arrangement including an actuating button including an actuating portion extending through said slot to the exterior of said housing, an enlarged portion received in one of said channels and dimensioned larger than said slot to be able to bypass said partioning wall means only when displaced out of said channels into the interior of said housing, and means for urging said enlarged portion of said actuating button into the respective one of said channels; and means for connecting said actuating button arrangement to said distancing element.

7. The grooming device as defined in claim 1, wherein said distancing element has a substantially comb-shaped configuration.

8. The grooming device as defined in claim 4, wherein said driving means includes an externally splined output shaft; and wherein said driving member is hollow and internally splined to at least partially receive said output shaft and to be driven in rotation thereby.

9. The grooming device as defined in claim 8, wherein said driving means includes an electric motor.

10. The grooming device as defined in claim 9, wherein said output shaft is the output shaft of said electric motor.

11. The grooming device as defined in claim 9, wherein said electric motor has an additional output shaft; and further including a train of spur gears interposed between said additional output shaft and said splined output shaft.

12. The grooming device as defined in claim 9, wherein said electric motor has an additional output shaft; and further including at least two meshing bevel gears interposed between said additional output shaft and said splined output shaft.

13. A grooming device for use in cutting hair growing at diverse locations of the human head outside the scalp area, comprising:

a housing;

means for cutting hair located in and adjacent various channels of the human head, including a protective element and a cutting element mounted in said protective element for rotation about an axis;

means for mounting said cutting means on said housing for telescoping movement into and out of said housing in unison between a retracted position in which said cutting means is at least predominantly situated within the outline of said housing, and an extended position in which said cutting means extends to a considerable extent beyond the outline of said housing;

said protective element including an elongated tubular shielding portion having two longitudinally spaced end portions one of which is closer to said housing at least in said extended position, and a substantially dome-shaped head portion receivable in a channel of the human head and having a base diameter exceeding that of said shielding portion, said head portion being mounted on the other of said end portions of said shielding portion, and bounding a cutting head compartment, and said cutting element including a hollow, internally splined, elongated driving member rotatably supported in said shielding portion, and a cutting head substantially conformingly received in said cutting head compartment of said head portion;

means for driving said cutting element in rotation relative to said protective element about said axis at least in said extended position of said cutting means, said driving means including an electric motor having an externally splined output shaft at least partially received in said hollow, internally splined driving member for driving the same in rotation, said driving member being mounted on said output shaft for telescoping movement therealong between said retracted and extended position; and means for arresting said cutting means at least in said extended position thereof relative to said housing.

14. The grooming device as defined in claim 13, wherein said arresting means includes at least one substantially axially extending opening in said housing, and at least one confining channel extending circumferentially from said opening in said housing, and at least one substantially radial projection extending outwardly from said shielding portion within said housing and so disposed and dimensioned as to pass through said opening when aligned therewith as said cutting means approaches said extended position thereof, and to be confiningly received in said confining channel in said extended position of said cutting means upon turning of said shielding portion in one direction about said axis.

15. The grooming device as defined in claim 13, wherein said arresting means includes at least one substantially axially extending through slot in said housing, said slot including at least one end portion that extends circumferentially and slightly in the opposite axial direction from the main course of said slot, and at least one substantially radially extending pin-shaped projection extending outwardly from said shielding portion within said housing and through said slot to the exterior of said housing to be engaged and manipulated into said one end portion as said cutting means is displaced toward and into said extended position thereof.

16. A grooming device for use in cutting hair growing at diverse locations of the human head outside the scalp area, comprising:

a housing;

means for cutting hair located in and adjacent various channels of the human head, including a protective element and a cutting element mounted in said protective element for rotation about an axis;

means for mounting said cutting means on said housing for telescoping movement into and out of said housing in unison between a retracted position in which said cutting means is at least predominantly situated within the outline of said housing, and an extended position in which said cutting means extends to a considerable extent beyond the outline of said housing;

said protective element including an elongated tubular shielding portion having two longitudinally spaced end portions one of which is closer to said housing at least in said extended position, and a head portion mounted on the other of said end portions of said shielding portion and bounding a cutting head compartment, and said cutting element including an elongated driving member rotatably supported in said shielding portion, and a cutting head substantially conformingly received in said cutting head compartment of said head portion; and means for driving said cutting element in rotation relative to said protective element about said axis at least in said extended position of said cutting means, said driving means including an electric motor, an externally splined output shaft, an additional output shaft, and a train of spur gears interposed between said additional output shaft and said splined output shaft, said driving member being hollow and internally splined to at least partially receive said externally splined output shaft and to be driven in rotation thereby.

17. The grooming device as defined in claim 16, and further comprising means for trimming hair, mounted at a location of said housing that is remote from the location of said cutting means.

18. The grooming device as defined in claim 17 wherein said trimming means includes two trimming blades mounted on said location for movement relative to one another, at least that of said trimming blades that is more remote from said housing having a recess therein; and further comprising means for driving said trimming means, including an electric clipper; and at least one distancing element mounted on said housing for movement between a retracted position in which it is accommodated in said recess of said remote cutting blade, and at least one extended position in which it is spaced a predetermined distance from said remote trimming blade.

19. A grooming device for use in cutting hair growing at diverse locations of the human head outside the scalp area, comprising:

a housing;

means for cutting hair located in and adjacent various channels of the human head, including a protective element and a cutting element mounted in said protective element for rotation about an axis;

means for mounting said cutting means on said housing for telescoping movement into and out of said housing in unison between a retracted position in which said cutting means is at least predominantly situated within the outline of said housing, and an extended position in which said cutting means extends to a considerable extent beyond the outline of said housing;

said protective element including an elongated tubular shielding portion having two longitudinally spaced end portions one of which is closer to said housing at least in said extended position, and a head portion mounted on the other of said end portions of said shielding portion and bounding a cutting head compartment, and said cutting element including an elongated driving member rotatably supported in said shielding portion, and a cutting head substantially conformingly received in said cutting head compartment of said head portion; and means for driving said cutting element in rotation relative to said protective element about said axis at least in said extended position of said cutting means, said driving means including an electric motor, an externally splined output shaft, an additional output shaft, and at least two meshing bevel gears interposed between said additional output shaft and said splined output shaft, said driving member being hollow and internally splined to at least partially receive said externally splined output shaft and to be driven in rotation thereby.

* * * * *